US009874207B2

(12) United States Patent
Bückle

(10) Patent No.: US 9,874,207 B2
(45) Date of Patent: Jan. 23, 2018

(54) HOSE PUMP WITH GUIDING-OUT DEVICE

(71) Applicant: ulrich GmbH & Co. KG, Ulm (DE)

(72) Inventor: Norbert Bückle, Bernstradt (DE)

(73) Assignee: ULRICH GMBH & CO. KG, Ulm (DE)

( * ) Notice: Subject to any disclaimer, the term of this patent is extended or adjusted under 35 U.S.C. 154(b) by 222 days.

(21) Appl. No.: 14/663,547

(22) Filed: Mar. 20, 2015

(65) Prior Publication Data

US 2015/0275888 A1 Oct. 1, 2015

(30) Foreign Application Priority Data

Mar. 27, 2014 (DE) ..... 10 2014 104 320

(51) Int. Cl.
*F04B 43/12* (2006.01)
*F04B 35/00* (2006.01)

(52) U.S. Cl.
CPC ..... *F04B 43/1253* (2013.01); *F04B 35/008* (2013.01)

(58) Field of Classification Search
CPC .... F04B 43/082; F04B 43/1253; F04B 43/08; F04B 53/22
USPC ..... 417/477.2, 477.9
See application file for complete search history.

(56) References Cited

U.S. PATENT DOCUMENTS 2,987,004 A * 6/1961 Murray ..... F01C 5/08 417/475
4,518,327 A * 5/1985 Hackman ..... F04B 43/1253 417/477.3
4,545,744 A 10/1985 Weber et al.
5,588,815 A 12/1996 Zaleski, II
5,630,711 A * 5/1997 Luedtke ..... F04B 43/1253 417/477.1

(Continued)

FOREIGN PATENT DOCUMENTS

DE 3326784 2/1985
DE 69615633 7/2002

(Continued)

OTHER PUBLICATIONS

Result of Examination Report for DE Patent Appl 10 2014 104 320.0 filed Mar. 27, 2014.

*Primary Examiner* — Peter J Bertheaud
(74) *Attorney, Agent, or Firm* — Paul D. Bianco; Katharine Davis; Fleit Gibbons Gutman Bongini & Bianco PL

(57) ABSTRACT

A hose pump for the conveyance of a fluid conducted in a hose, with several squeezing elements and with a hose bed, which has a hose inlet, a hose outlet, a guide surface, and a counter support, in which the hose is placed lying on the guide surface and is pressed by the squeezing elements against the counter support for the conveyance of the fluid found in the hose when the hose pump is operated in a conveyance direction. The hose pump has a guiding-out device for the automatic guiding of the hose out of the hose bed, and the guiding out of the hose takes place by means of the guiding-out device during the operation of the hose pump opposite its conveyance direction. For the development of an as low-cost as possible but nevertheless reliable guiding-out device, an elevation, located on the hose outlet of the hose bed, is provided, which protrudes over the guide surface and via which the hose is conducted.

20 Claims, 5 Drawing Sheets

(56) References Cited

U.S. PATENT DOCUMENTS

| | | | | |
|---|---|---|---|---|
| 7,223,079 | B2 * | 5/2007 | Ortega | F04B 43/1253 417/477.3 |
| 7,980,935 | B2 | 7/2011 | Feola | |
| 8,568,115 | B2 | 10/2013 | Lauer | |
| 2010/0129247 | A1 | 5/2010 | Lauer | |
| 2013/0045121 | A1 | 2/2013 | Rodau et al. | |

FOREIGN PATENT DOCUMENTS

| | | |
|---|---|---|
| DE | 10 2007 020 573 | 11/2008 |
| DE | 10 2010 000 954 | 7/2011 |
| DE | 10 2010 000 594 | 9/2011 |

* cited by examiner

HOSE PUMP WITH GUIDING-OUT DEVICE

BACKGROUND

Such hose pumps are known, for example, from DE 10 2010 000 594 B4, DE 33 26 784 A1, and DE 10 2007 020 573 A1. These known hose pumps have a guiding-in and guiding-out device for the automatic guiding in and guiding out of a pump hose. DE 33 26 784 A1 shows a peristaltically operating roller pump with a pump bed, a rotating rotor that carries rotatable rollers on its circumference, and a pump hose, which is radially located between a pressure-side connection and a suction-side connection outside the rollers, along an inside support wall of the pump bed, and presses against the support wall in the area of the rollers, and is occluded in this way. For the guiding in and guiding out of the hose into or out of the pump bed, the rotor has a hold-down device that points radially outward in its circumferential area between the two adjacent rollers; this hold-down device presses the hose for the guiding into the pump bed, and for the guiding out during the rotation of the rotor, raises it in the reverse direction out of the pump bed.

From DE 10 2007 020 573 A1, a hose roller pump with a guiding-in device is likewise known; it has hose guide wings, which are used for the automatic guiding in and out of the hose into the pump. The known guiding-in and guiding-out devices, however, have proved susceptible to failure in actual practice. Moreover, these guiding-in and guiding-out devices do not guarantee a completely automatic guiding in and out of the hose.

From DE 10 2010 000 954 B4, a hose pump with a completely automatic guiding-in and guiding-out device is known, which comprises a worm spindle driven by a spindle drive. This guiding-in and guiding-out device makes possible a completely automatic guiding in and out of the hose. However, for the purpose, a spindle drive is needed for the worm spindle, which increases the manufacturing costs of the pump.

SUMMARY OF THE DISCLOSURE

Proceeding from this, some embodiments relate to a generic hose pump with a completely automatic guiding-out device with which a simple and quick guiding out of the hose from the hose pump is made possible, wherein the manufacturing costs for the hose pump due to the guiding-out device should not be appreciably increased.

Preferred embodiments of this hose pump are also disclosed.

The hose pump in accordance with the disclosure has a hose bed with a hose inlet, a hose outlet, a guide surface, and a counter support, and several squeezing elements, which press a hose that has been placed in the hose bed and is lying there on the guide surface against the counter layer during the operation of the hose pump in a conveyance direction, so as to convey a fluid moving in the hose. The hose pump in accordance with the disclosure has a guiding-out device to guide the hose out of the hose bed; it allows the inserted hose to be automatically guided out of the hose bed during the operation of the hose pump, opposite its conveyance direction. For the purpose, the guiding-out device has a (stationary) elevation located on the hose outlet of the hose bed; it protrudes over the guide surface of the hose bed. The guiding-out device is thereby located, in a stationary manner, on the hose outlet of the hose bed. During the operation of the hose pump against its conveyance direction, the hose is pulled over the elevation on the hose outlet of the hose bed by the squeezing elements and, in this way, raised upward. By raising the hose on the hose outlet, it is lifted from the hose outlet, beginning from the hose bed and beyond the squeezing element, while the hose pump is operated opposite its conveyance direction, and the hose is thus guided out of the hose pump; as the hose pump is further operated opposite its conveyance direction, this continues until the hose has been guided completely out of the hose bed and the squeezing elements no longer engage with the counter element.

In a preferred embodiment, the elevation located on the outlet side of the hose bed has a surface with a curvature that is at least essentially convex, for example, a semi-cylindrically curved surface. The elevation can also be designed in the shape of a ramp. Preferably, at least on the outlet side of the hose bed, the elevation has a surface with a convex curvature and declines in the conveyance direction to the guide surface. It has proved to be particularly appropriate if the gradient of the elevation on the inlet side (in the conveyance direction, that is, in the direction from the hose inlet to the hose outlet) is flatter than the gradient on the outlet side, which declines in the conveyance direction to the guide surface. During the operation of the hose pump in the conveyance direction, in which the fluid found in the hose is conveyed in the direction from the hose inlet to the hose outlet, this formation of the elevation guarantees that the elevation does not exert a disruptive influence on the position of the hose in the hose bed and that it is at least not appreciably raised from the hose bed. Furthermore, an appropriate formation of the elevation ensures that, during the operation of the hose pump opposite its conveyance direction, the hose is raised far enough from the guide surface of the hose bed that it arrives above the squeezing elements, so that during the operation of the hose pump opposite its conveyance direction, the hose is disengaged from the squeezing elements and in this way can be guided out of the hose bed in a complete and reliable manner.

In a preferred embodiment, the hose is fixed on a first or a second fixing site, on the inlet side, before the hose inlet and/or, on the outlet side, after the hose outlet of the hose bed. It is particularly appropriate if the first and second fixing sites are thereby formed by the housing of a cassette, in which the hose is clamped in, and in particular, cast. The section of the hose that protrudes from the housing of the cassette is thereby bent appropriately to form a loop shape, for example, in the form of a semicircle or a semi-ellipse. The cassette is appropriately located in a housing of the hose pump in such a way that it can be replaced and preferably locked there in a way which allows its removal.

The squeezing elements of the hose pump are, for example, formed by several squeezing rollers, which are supported on a rotatable carrier disk. The surface of the carrier disk thereby forms the hose bed guide surface on which the hose inserted in the hose bed is lying. The carrier disk is thereby coupled with a drive, which starts the rotation of the carrier disk when the hose pump is in operation. In this way, the squeezing rollers located on the carrier disk move relative to the hose fixed in the hose bed. By the movement of the squeezing rollers relative to the stationary hose, the hose is pressed by the squeezing rollers against the counter support and thus compressed, wherein the fluid found in the hose is transported in the conveyance direction. The squeezing rollers can thereby be supported on the carrier disk so they can be appropriately rotated and thus, with a rotating carrier disk, can roll with their outer circumference on the hose surface.

In a preferred embodiment example, a guide roller is located on the carrier disk between adjacent squeezing rollers. Just like the squeezing rollers, the guide rollers can be supported so they can rotate on the carrier disk or can also be connected with the carrier disk in a stationary manner. Appropriately, on their outer circumference, the guide rollers have a surrounding guide groove, which is appropriately adapted to the form of the hose and is semicircular in its cross section. As a result of the formation of the guide groove on the outer circumference of the guide rollers, they are adjusted to the surface of the hose, without squeezing it, when the hose pump is in operation. In this way, when the hose pump is in operation, a reliable and constant guidance of the hose in the hose bed is guaranteed.

Preferably, in addition to the guiding-out device, the hose pump also has a guiding-in device for the automatic guiding of the hose into the hose bed, wherein the guiding-in device guides the hose, preferably automatically, into the hose bed between the squeezing elements and the counter support during the operation of the hose pump in the conveyance direction. The guiding-in device is thereby formed, in a preferred embodiment example, by at least one hold-down device located on the inlet side before the hose inlet of the hose bed, which presses the hose downward against a contact surface during the guiding in and when the hose pump is operating in the conveyance direction. The hold-down device is appropriately located on the inside of a swiveling housing lid. When the swiveling housing lid is closed, the hold-down device presses the hose downward against the contact surface and thus, when the hose pump is in operation in the conveyance direction, takes care that the hose is predominantly engaged by a guide roller and the counter support or also a squeezing element and the counter support, and in this way is continuously pulled into the hose bed, beginning from the hose inlet to the hose outlet, and there is placed on the guide surface of the hose bed in a lying position. The hose can thus be guided into the hose pump completely automatically, without the manual support of a user.

BRIEF DESCRIPTION OF THE DRAWINGS

These and other advantages and features of the hose pump in accordance with the disclosure can be deduced from the embodiment example, described below with reference to the accompanying drawings. The drawings show the following.

DETAILED DESCRIPTION

Figure 1:
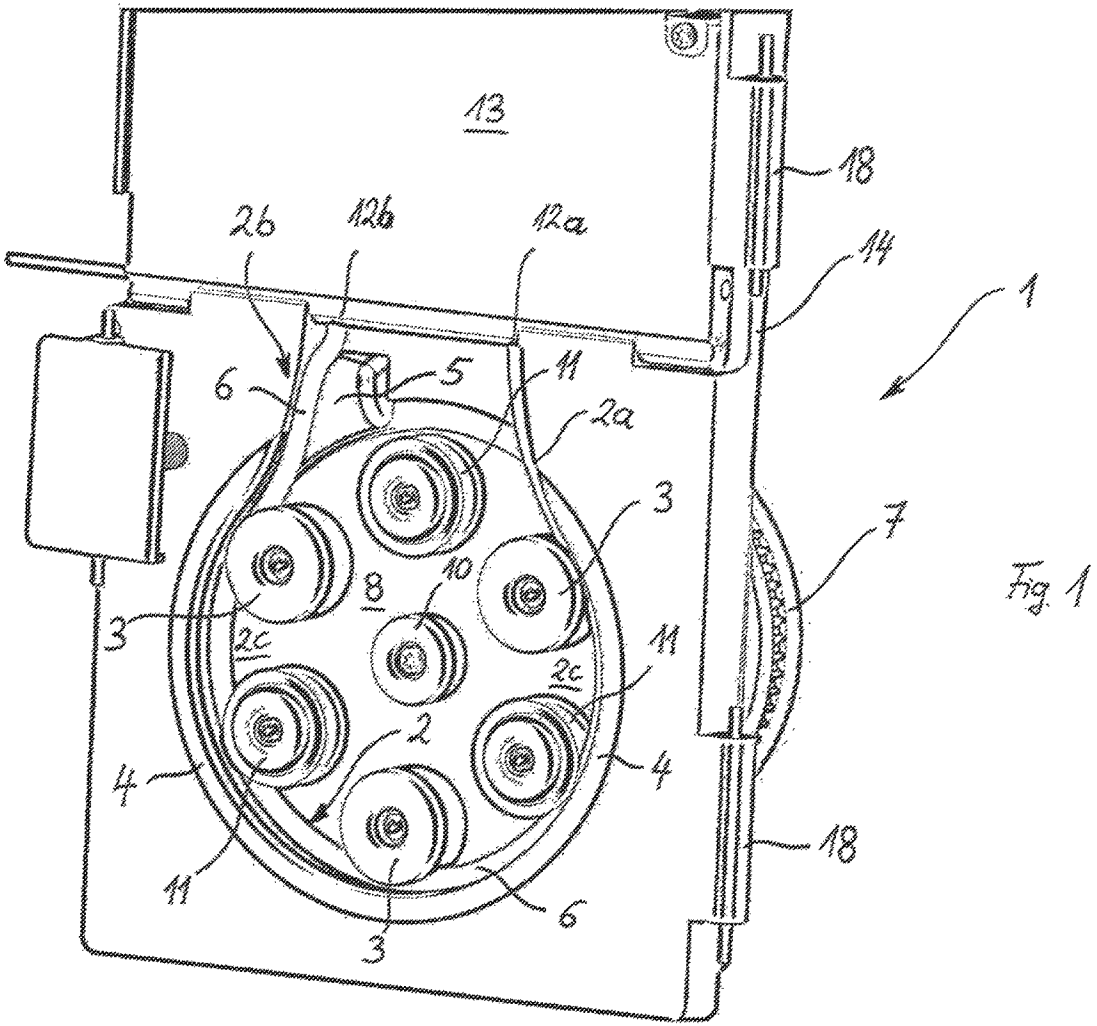
FIG. 1: Perspective depiction of a hose pump in accordance with the disclosure with a housing lid that has been removed (for a better depiction)
Figure 2:
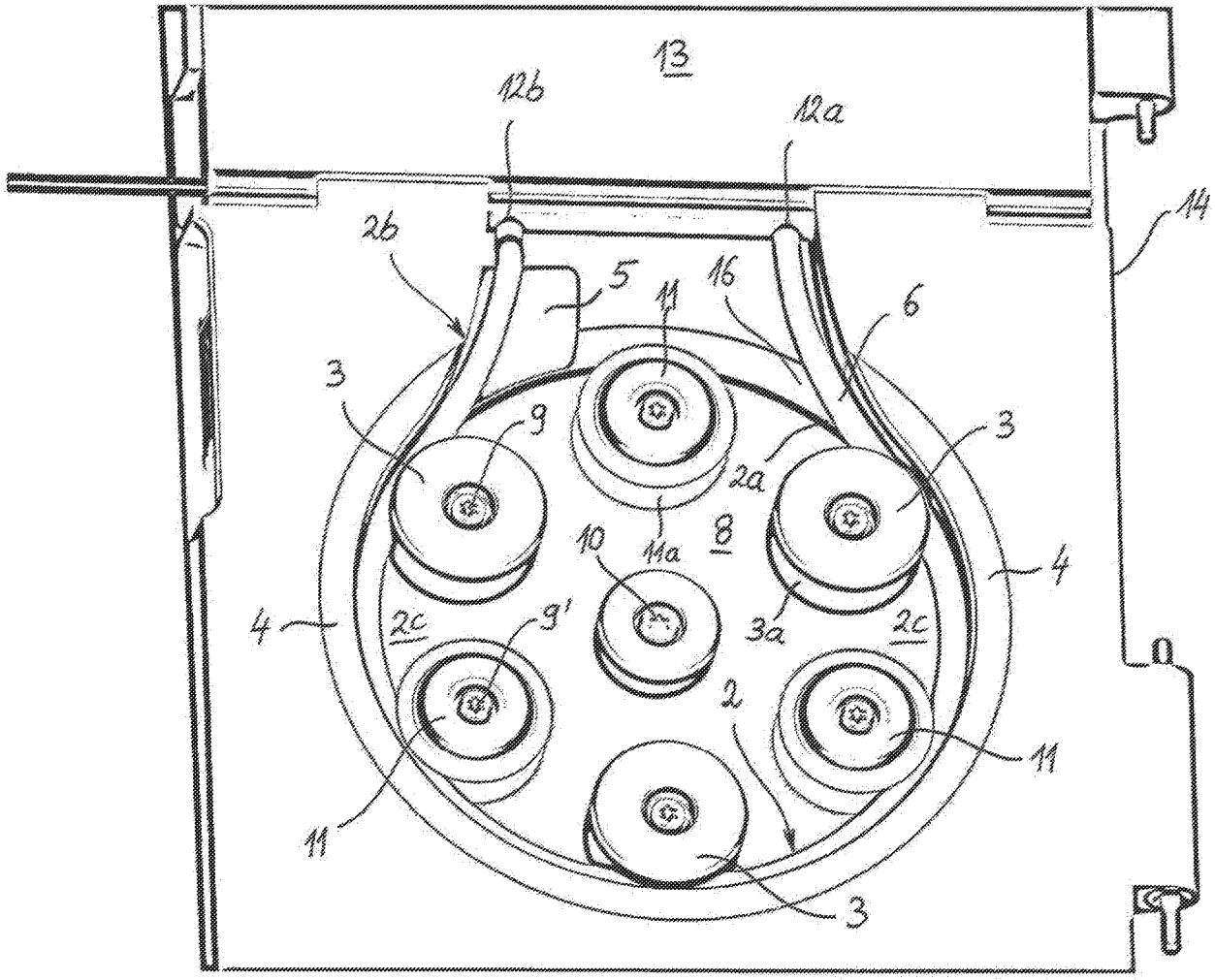
FIG. 2: detailed view of the hose bed of the hose pump of FIG. 1 with a removed housing lid.
Figure 5B:
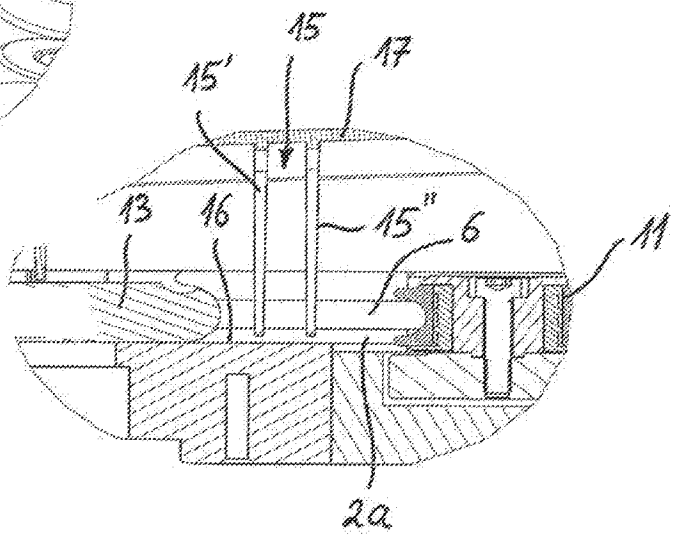
FIG. 5B: sectional depiction of the inlet area of the hose bed of FIG. 2 with a closed housing lid.
Figure 5A:
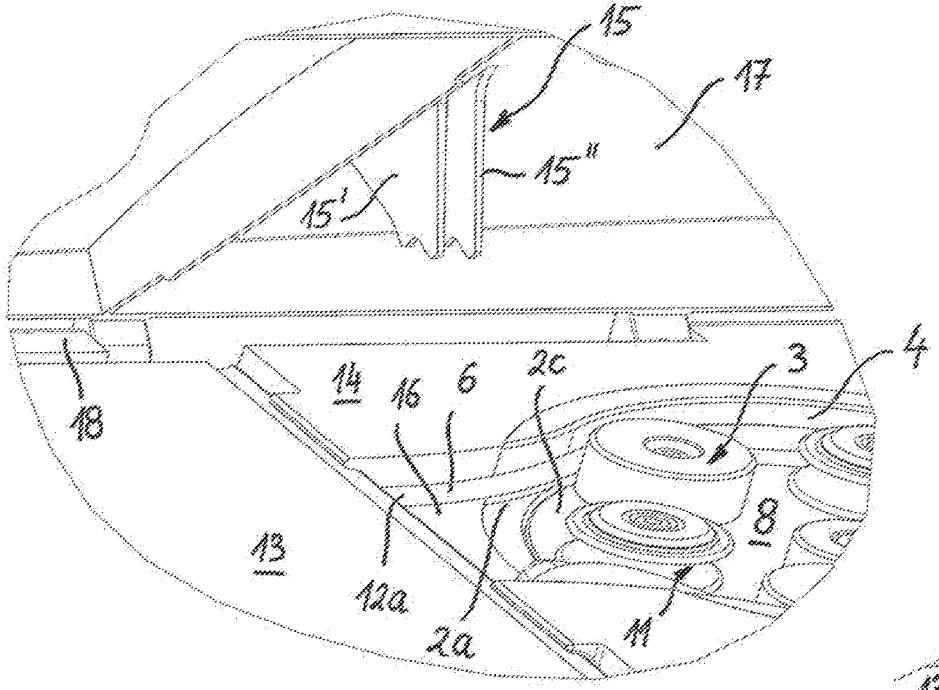
FIG. 5A: perspective detailed depiction of the inlet area of the hose bed of FIG. 2 with opened housing lid

FIG. 1 and FIG. 2 show a hose pump in accordance with the disclosure in a perspective depiction. The hose pump 1 is used to convey a fluid moving in a hose, for example, an injection liquid for a medicinal injection. The hose pump 1 is located in a pump housing 14, on which a swiveling housing lid 17 is hinged by means of a fastening device 18. The housing lid 17 is removed in the depictions of FIGS. 1 and 2 for reasons having to do with a better overview. FIG. 5 shows the housing lid 17 in an opened position (FIG. 5*a*) and in a closed position (FIG. 5*b*).

The hose pump 1 comprises a carrier disk 8, which is coupled with a drive 7 via a drive shaft 10 that is located centrally in the carrier disk 8. The drive 7 is, for example, an electric motor. The carrier disk 8 is made to rotate, when the drive 7 is running, via the drive shaft 10, which is connected in a stationary manner with the carrier disk 8.

The hose pump 1 also comprises a hose bed 2 with a hose inlet 2*a*, a hose outlet 2*b*, and a counter support 4. The counter support 4 is formed by the inner circumference of a circular segment, which is open in the area of the hose inlet 2*a* and the hose outlet 2*b* of the hose bed 2, for the guiding in of a hose 6. The surface of the carrier disk 8 forms a guide surface 2*c* of the hose bed 2. The hose bed 2 is used to hold a hose 6, in which a fluid, for example, an injection liquid for injection into the bloodstream of a patient, is conducted.

Several squeezing elements 3 are located on the surface of the carrier disk 8, near its outer circumference. In the embodiment example of the hose pump in accordance with the disclosure graphically depicted here, the squeezing elements 3 are formed by cylindrical squeezing rollers that have an outer circumference 3*a*. In the graphically depicted embodiment example, three such squeezing rollers are uniformly distributed over the circumference of the carrier disk 8. A guide roller 11 is located between adjacent squeezing element 3 (squeezing rollers). The guide rollers 11 have a surrounding guide groove 11*a* on their outer circumference. Both the squeezing rollers 3 and also the guide rollers 11 are supported so they can be appropriately rotated on the carrier disk 8, wherein the rotation axes 9 of the squeezing rollers 3 and the rotation axes 9' of the guide rollers 11 run parallel to the drive shaft 10. The squeezing rollers 3 and the guide rollers 11 can thereby be supported either so they can freely rotate on the carrier disk 8 or also they can be coupled with the drive 7 via a coupling. If the squeezing rollers 3 and/or the guide rollers 11 are coupled with the drive 7 via a coupling, then when the drive 7 is running, they are made to rotate by the drive in the same direction as the carrier disk 8.

The housing 14 of the pump 1 contains a cassette holder for the insertion of a replaceable cassette 13. The hose 6 is integrated in the cassette 13 and an arch-shaped section of the hose 6 protrudes from the cassette 13. The sites on which the loop-shaped, bent section of the hose 6 protrudes from the cassette 13 form a first fixing site 12*a* and a second fixing site 12*b*. With the cassette 13 inserted in the housing 14, these fixing sites 12*a*, 12*b* ensure a fixing of the ends of the section of the hose 6 protruding from the cassette 13.

Figure 3:
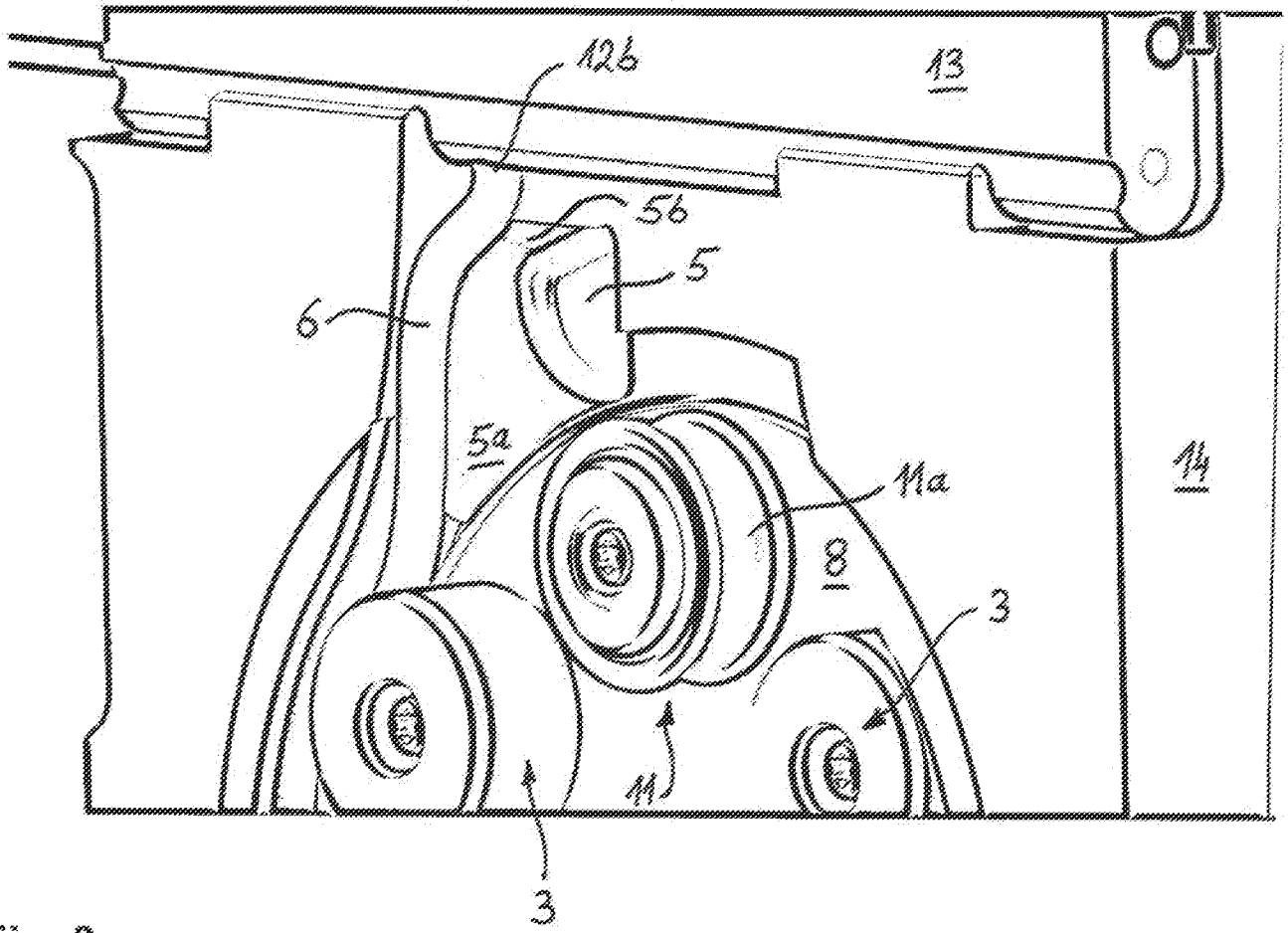
FIG. 3: detailed depiction of the outlet area of the hose bed of FIG. 2.
Figure 4:
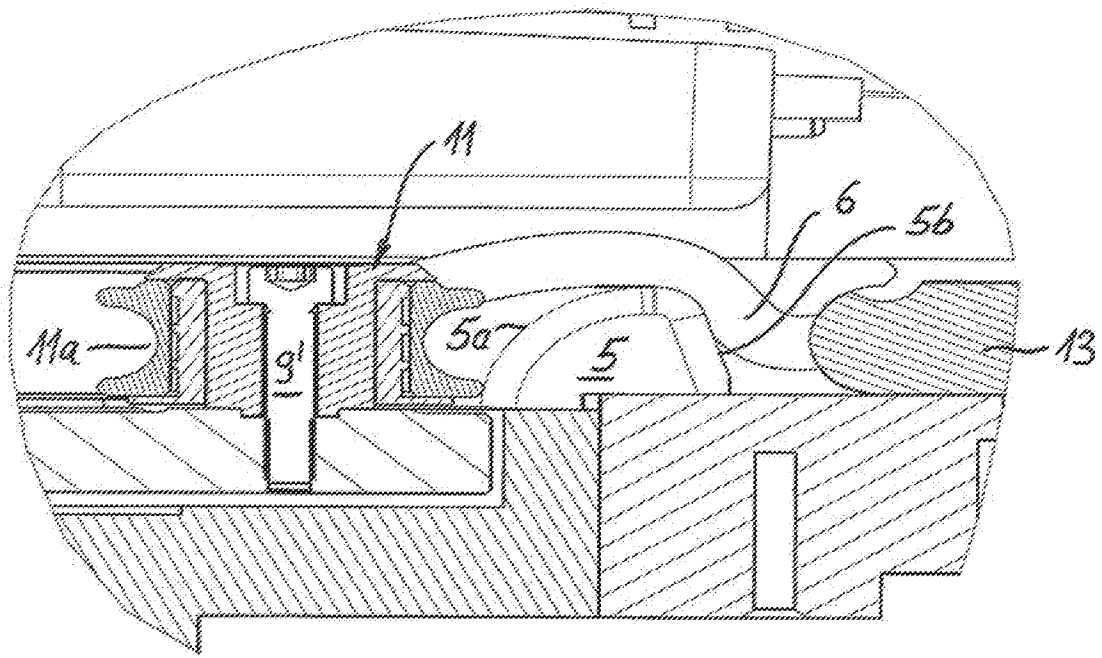
FIG. 4: sectional depiction of the outlet area of the hose bed of FIG. 3.

A guiding-out device is located in the area of the hose outlet 2*b* of the hose bed 2. It comprises an elevation 5, which projects over the guide surface 2*c*. The elevation 5 is shown in detail in FIG. 3, in a perspective side view. The elevation 5 has a surface with an at least essentially convex curvature. The surface of the elevation 5 can be designed, for example, semi-cylindrically. In this case, the elevation has a slope on the inlet side (that is, in the conveyance direction, or in the direction from the hose inlet to the hose outlet), which is just as large as the opposite outlet slope. Preferably, the surface of the elevation 5, however, is shaped as is shown in FIGS. 3 and 4. In this graphically depicted embodiment, the elevation has an inlet slope 5*a* and an outlet slope 5*b*, wherein the inlet slope 5*a* is flatter than the outlet slope 5*b*.

The section of the hose 6 protruding from the cassette 3 is placed in the hose bed 2 for the operation of the hose pump 1, wherein the hose 6 lies on the guide surface 2*c* and is between the outer circumference of the squeezing elements 3 and the counter support 4 and between the guide groove 11*a* of the guide rollers 11 and the counter support 4. The hose 6 inserted into the hose bed 2 is conducted in the area of the hose outlet 2*b* over the elevation 5, as shown in FIG. 2. During the operation of the hose pump in its conveyance direction, the carrier disk 8 (and perhaps via a gear, the squeezing elements 3 and the guide rollers 11 located thereon) is made to rotate by the drive 7. In the embodiment example shown in FIG. 1, the carrier disk 8 is made to rotate in a clockwise direction by the drive 7 during the operation of the hose pump in the conveyance direction. The section of the hose 6 lying in the hose bed 2 is thereby pressed by the squeezing element 3 against the counter support 4, wherein the hose is intermittently squeezed and the fluid found in the hose 6 is conveyed in the direction from the hose inlet 2*a* to the hose outlet 2*b*. The guide rollers 11 thereby ensure a reliable and constant positioning of the section of the hose 6 in the hose bed 2, in that the hose 6 engages in the cross section of the essentially semicircular guide groove 11*a* of the guide rollers 11 so that it is conducted.

The guiding-out device, located in the area of the hose outlet 2*b*, is used for the automatic guiding out of the hose 6 from the hose pump 1 after the ending of pumping operation. To this end, the hose pump is operating opposite its conveyance direction, that is, in the embodiment example graphically depicted here, the carrier disk 8 is rotated in a counterclockwise direction by the drive 7. In this way, as a result of the engagement of the hose 6 between the squeezing elements 3 and the counter layer 4, a tensile force is exerted on the hose 6, which acts opposite the conveyance direction (that is, in a counterclockwise direction). With the influence of this tensile force on the hose 6, it is raised above the elevation 5, away from the guide surface 2*c*, upward. The hose section that lies on the surface of the elevation 5 with a convex curvature slides, in particular, along the outlet slope 5*b*, upward. As a result of the steep outlet slope 5*b* of the elevation 5, the section of the hose 6 that lies in the hose bed 2 is thereby raised upward away from the guide surface 2*c* in such a way that it comes to lie above the squeezing element 3 that is right on the hose outlet 2*b* or a guide roller 11 standing there. This triggers an engagement between this squeezing element 3 or this guide roller 11 and the counter support 4. With additional rotation of the carrier disk 8 opposite the conveyance direction of the hose pump 1, the engagement of the hose between the other squeezing elements 3 and the guide rollers 11 with the counter 4 is triggered in a corresponding manner, and the section of the hose 6 is raised from the hose bed 2 in this manner until the section of the hose 6 protruding from the cassette 13 has been completely guided out of the hose bed 2. In this position of the hose 6, the drive 7 can be switched off and the cassette 13 can be taken out of the housing 14 of the hose pump 1 and it can be replaced with a new cassette with a still unused hose.

For the guiding in of the section of the hose 6, protruding from the new cassette 13, a guiding-in device is appropriately provided in the area of the hose inlet 2*a*. This guiding-in device can be formed by a worm spindle driven by a motor, as is known from DE 10 2010 000 594 B4. A lower-cost guiding-in device, which dispenses with the use of a worm spindle driven by a motor, is not shown in FIG. 5. The guiding-in device thereby comprises a hold-down device 15, which presses the section of the hose 6 protruding from the cassette 13 for guiding it into the hose bed 2, downward against a contact surface 16. The contact surface 16 is thereby located on the inlet side of the hose bed that is still in front of the hose inlet 2*a* and is at least essentially found on the same plane as the guide surface 2*c* of the hose bed 2 or is slightly raised relative to this guide surface 2*c*. In the embodiment example graphically depicted here in FIG. 4, the hold-down device 15 is formed by two projections 15', 15" located on the inside of a swiveling housing lid 17; they appropriately have a round or oval recess on their end, into which the hose 6 can mesh when the housing lid 17 is closed. If the housing lid 17 shown in an opened position in FIG. 5*a* is brought to its closed position (FIG. 5*b*), the hold-down device 15 located on the inside of the housing lid 17 presses the hose 6 against the contact surface 16, in the area of the hose inlet 2*a*. Then, if the hose pump is operated in the conveyance direction in this position of the hose 6, in that the drive 7 drives the carrier disk 8 in the conveyance direction (that is, in the embodiment example shown here, rotates in a clockwise direction), the hose 6 is automatically guided into the hose bed 2. Beginning in the area of the hose inlet 2*a*, the hose 6 is engaged by a squeezing element 3 or a guide roller 11 and the counter support 4 and is guided into the hose bed 2, lying on the guide surface 2*c*. With additional rotation of the carrier disk 8 in the conveyance direction, the section of the hose 6 protruding from the cassette 13 is further guided along the hose bed 2 into the bed and in the conveyance direction until the entire section of the hose 6 protruding from the cassette 13 lies completely in the hose bed 2 and there appropriately lies on the guide surface 2*c*. On the hose outlet 2*b*, the outlet section of the hose 6 is conducted over the elevation 5, as shown in FIGS. 3 and 4. As a result of the flat course of the inlet slope 5*a* of the elevation 5, the elevation 5 does not disturb the position of the hose 6 in the hose bed 2 and, in particular, does not impair the engagement of the outlet hose section between the squeezing elements 3 or the guide rollers 11 and the counter support 4.

After the guiding in of the section of the hose 6 protruding from the cassette 13 into the hose bed 2 in the manner described, the pump for the conveyance of the fluid found in the hose 6 can be operated in its conveyance direction. For the purpose, in the embodiment example graphically depicted here, the carrier disk 8 is made to rotate in a clockwise direction by the drive 7, wherein the squeezing elements 3, while squeezing the hose 6, press the hose against the counter support 4, and in this way transport the fluid found in the hose in the conveyance direction.

The disclosure is not limited to the embodiment graphically depicted here. Thus, the squeezing elements 3, for example, can be shaped differently, for example, as rectangles. Furthermore, the shape of the elevation 5 can be shaped differently, for example, in the shape of a ramp. The provision of guide rollers is optional and is used only for the better guidance and positioning of the hose in the hose bed when the pump is running. By the preferred formation of the outer circumference of the guide rollers with a surrounding guide groove, they also contribute, however, to a reliable guiding in and out of the hose, using the guiding-in device or the guiding-out device.

The invention claimed is:

1. A hose pump for conveying a fluid through a hose, the hose pump comprising:

a hose bed having a hose inlet, a hose outlet, a guide surface, and a counter support;

a plurality of squeezing elements formed by squeezing rollers; and a guiding-out device for the hose formed by an elevation on the hose outlet, the elevation protruding over the guide surface and having, at least on an outlet side of the hose bed, an elevation surface with a convex curvature declining in a conveyance direction of the fluid;

wherein the hose is placed on the guide surface and pressed against the counter support by the squeezing rollers for conveying fluid through the hose during operation of the hose pump in the conveyance direction; and wherein the guiding-out device is configured and arranged for automatic guiding of the hose out of the hose bed during operation of the hose pump in a direction opposite the conveyance direction.

2. The hose pump according to claim 1, wherein the elevation has a shape of a ramp.

3. The hose pump according to claim 1, wherein the surface of the elevation has an inlet slope and an outlet slope.

4. The hose pump according to claim 3, wherein the inlet slope runs flatter than the outlet slope.

5. The hose pump according to claim 1, wherein the hose is fixed and clamped on at least one of a first or a second fixing site on an inlet side of the hose bed in front of the hose inlet or on the outlet side of the hose bed after the hose outlet.

6. The hose pump according to claim 5, wherein the first or the second fixing site is formed by a removable cassette, the removable cassette for clamping or casting the hose.

7. The hose pump according to claim 6, wherein the removable cassette is removably locked on a housing of the hose pump.

8. The hose pump according to claim 1, further comprising a carrier disk, wherein a surface of the carrier disk forms the guide surface.

9. The hose pump according to claim 8, wherein the squeezing rollers are supported approximate an outer circumference of the carrier disk and wherein an axis of each of the squeezing rollers runs parallel to a drive shaft of a drive of the hose pump.

10. The hose pump according to claim 9, wherein the carrier disk or each of the squeezing rollers is rotated by the drive when the hose pump is running.

11. The hose pump according to claim 9, wherein the carrier disk and each of the squeezing rollers are rotated by the drive when the hose pump is running.

12. The hose pump according to claim 8, further comprising a plurality of guide rollers, each of the guide rollers located on the carrier disk positioned between adjacent squeezing rollers.

13. The hose pump according to claim 12, wherein each of the plurality of guide rollers has a groove around an outer circumference, the groove adapted to a form of the hose.

14. The hose pump according to claim 1, further comprising a guiding-in device for the hose, the guiding-in device automatically guiding the hose into the hose bed and between the squeezing rollers and the counter support during operation of the hose pump in the conveyance direction.

15. The hose pump according to claim 14, wherein the guiding-in device comprises at least one hold-down device positioned in front of the hose inlet, the guiding-in device configured for pressing the hose downward against a contact surface during guiding in of the hose.

16. The hose pump according to claim 15, wherein the at least one hold-down device is arranged on an inside surface of a swiveling lid of a housing for the hose pump.

17. A hose pump for conveying a fluid through a hose, the hose pump comprising:

a hose bed having a hose inlet, a hose outlet, a guide surface, and a counter support;

a plurality of squeezing elements formed by squeezing rollers; and a guiding-out device for the hose formed by an elevation on the hose outlet, the elevation protruding over the guide surface, wherein a surface of the elevation has an inlet slope and an outlet slope and is curved in a substantially convex curve or a semi-cylindrical curve, the inlet slope running flatter than the outlet slope;

wherein the hose is placed on the guide surface and pressed against the counter support by the squeezing rollers for conveying fluid through the hose during operation of the hose pump in the conveyance direction; and wherein the guiding-out device is configured and arranged for automatic guiding of the hose out of the hose bed during operation of the hose pump in a direction opposite the conveyance direction.

18. The hose pump according to claim 17, wherein the hose is fixed and clamped on at least one of a first or a second fixing site on the inlet side of the hose bed in front of the hose inlet or on the outlet side of the hose bed after the hose outlet and wherein the first or the second fixing site is formed by a removable cassette, the removable cassette for clamping or casting the hose.

19. The hose pump according to claim 17, further comprising a carrier disk, wherein a surface of the carrier disk forms the guide surface.

20. The hose pump according to claim 19, wherein the squeezing rollers are supported approximate an outer circumference of the carrier disk and wherein an axis of each of the squeezing rollers runs parallel to a drive shaft of a drive of the hose pump.

* * * * *